United States Patent [19]

Obata et al.

[11] Patent Number: 4,990,194

[45] Date of Patent: Feb. 5, 1991

[54] THIN HIGH-STRENGTH ARTICLE OF SPHEROIDAL GRAPHITE CAST IRON AND METHOD OF PRODUCING SAME

[75] Inventors: Fumio Obata; Hideaki Nagayoshi, both of Kitakyusyu; Eiji Nakano, Saikawa, all of Japan

[73] Assignee: Hitachi Metals, Ltd., Tokyo, Japan

[21] Appl. No.: 403,876

[22] Filed: Sep. 7, 1989

[30] Foreign Application Priority Data

Sep. 9, 1988 [JP] Japan ..... 63-225830
Feb. 9, 1989 [JP] Japan ..... 1-30167

[51] Int. Cl.[5] ..... C22C 37/04; C21D 5/00

[52] U.S. Cl. ..... 148/3; 148/321; 148/139

[58] Field of Search ..... 148/321, 139, 3; 420/9, 420/13, 15, 16, 17

[56] References Cited

U.S. PATENT DOCUMENTS 4,475,956 10/1984 Kovacs et al. ..... 148/321
4,572,751 2/1986 Oguri et al. ..... 148/321

FOREIGN PATENT DOCUMENTS 57-28669 2/1982 Japan .

*Primary Examiner*—Deborah Yee
*Attorney, Agent, or Firm*—Finnegan, Henderson, Farabow, Garrett & Dunner

[57] ABSTRACT

A thin high-strength article of spheroidal graphite cast iron having graphite particles dispersed in a ferrite matrix containing 10% or less of pearlite, characterized in that there are substantially no fine gaps between the graphite particles and the ferrite matrix. It is produced by pouring a melt having a spheroidal graphite cast iron composition into a casting mold; removing the casting mold by shake-out, while substantially the entire portion of the resulting cast iron product is still at a temperature of its $A_3$ transformation point or higher; immediately introducing the cast iron product into a uniform temperature zone of a continuous furnace kept at a temperature of the $A_3$ transformation point or higher, where the cast iron product is held for 30 minutes or less to decompose cementite contained in the matrix; and transferring the cast iron product into a cooling zone of the continuous furnace to cool the cast iron product at such a cooling speed as to achieve the ferritization of the matrix.

12 Claims, 4 Drawing Sheets

×100

×960

×960

THIN HIGH-STRENGTH ARTICLE OF SPHEROIDAL GRAPHITE CAST IRON AND METHOD OF PRODUCING SAME

BACKGROUND OF THE INVENTION

The present invention relates to a thin high-strength article of spheroidal graphite cast iron and a method of producing it.

In the production of spheroidal graphite cast iron having a ferrite matrix, cast iron products are usually left to stand in the air after removal from molds so that they are cooled to low temperatures such as room temperature, and they are heated again to temperatures higher than their $A_3$ transformation points, particularly 850°-950° C. to conduct the ferritization of pearlite contained in their matrices. When this heat treatment is conducted on thin spheroidal graphite cast iron products, primarily precipitated graphite particles hereinafter referred to as "primary graphite particles" are diffused in the matrices, leaving fine gaps around their graphite particles. As a result, the thin spheroidal graphite cast iron products inevitably have reduced mechanical properties particularly fatigue strength.

In addition, since the spheroidal graphite cast iron products are heated to a high temperature after cooled to room temperature, a large amount of thermal energy is consumed, meaning that this process is economically disadvantageous.

Japanese Patent Laid-Open No. 57-28669 discloses a method of producing a thin as-cast spheroidal graphite cast iron product. In this method, a spheroidal graphite cast iron product having portions of different thicknesses is cooled such that every portion is cooled at a cooling speed of 13 ° C./min or more, so that a matrix structure containing 50°-90° of pearlite can be stably obtained in an as-cast state. However, this method fails to provide high-strength spheroidal graphite cast iron products having matrices substantially consisting of ferrite and free from fine gaps around graphite particles, thereby showing excellent mechanical properties.

OBJECT AND SUMMARY OF THE INVENTION

Accordingly, an object of the present invention is to provide a thin high-strength article of spheroidal graphite cast iron having good mechanical properties, particularly improved fatigue strength.

Another object of the present invention is to provide a method of producing such a thin high-strength article of spheroidal graphite cast iron with low thermal energy consumption.

In view of the above objects, the inventors of the present invention have found that by heat-treating a thin article of spheroidal graphite cast iron, without cooling it to room temperature after removal from a mold, at a temperature of its $A_3$ transformation point or higher for a short period of time and cooling it at a controlled cooling speed, the diffusion of graphite particles into the surrounding ferrite matrix of the spheroidal graphite cast iron can be effectively prevented while achieving the ferritization of the matrix, whereby spheroidal graphite cast iron products substantially free from fine gaps around the graphite particles in the matrix can be obtained, and that such spheroidal graphite cast iron products have extremely improved mechanical properties, particularly fatigue strength. The present invention is based upon this finding.

Thus, the thin high-strength article of spheroidal graphite cast iron according to the present invention has graphite particles dispersed in a ferrite matrix containing 10% or less of pearlite, and is characterized in that there are substantially no fine gaps between the graphite particles and the ferrite matrix.

The method of producing a thin high-strength article of spheroidal graphite cast iron according to the present invention comprises the steps of pouring a melt having a spheroidal graphite cast iron composition into a casting mold; removing the casting mold by shake-out after the completion of solidification of the melt, while substantially the entire portion of the resulting cast iron product is still at a temperature of its $A_3$ transformation point or higher; introducing the cast iron product into a uniform temperature zone of a continuous furnace kept at a temperature of the $A_3$ transformation point or higher, where the cast iron product is kept for 30 minutes or less to decompose cementite contained in the matrix: and transferring the cast iron product into a cooling zone of the continuous furnace to cool the cast iron product at such a cooling speed as to conduct the ferritization of the matrix.

DETAILED DESCRIPTION OF THE INVENTION

Figure 1:
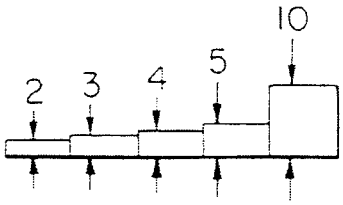
FIG. 1 is a side view showing a specimen having a stepwise increasing thickness.

In the metal structure of the thin, high-strength spheroidal graphite cast iron article according to the present invention, there are substantially no fine gaps between graphite particles and a ferrite matrix. The graphite particles have an average particle size of 20 μm or less and a maximum particle size of 60 μm or less.

To produce the thin, high-strength spheroidal graphite cast iron article having such structure, the cast iron product having a spheroidal graphite cast iron composition is removed from a mold while substantially the entire cast iron product is still at a temperature of its $A_3$ transformation point (about 850° C.) or higher after the solidification, and introduced into a continuous furnace kept at a temperature of its $A_3$ transformation point or higher, and then subjected to a ferritization treatment while preventing the formation of a pearlite phase in the matrix by controlling the cooling speed.

In the continuous furnace, the cast iron product is held in a uniform temperature zone kept at a temperature of the $A_3$ transformation point or higher for 30 minutes or less, preferably 1–25 minutes, and more preferably 5–20 minutes. The temperature of the uniform temperature zone of the continuous furnace is preferably 850°–950° C.

It is a surprising discovery that substantially all cementite can be decomposed or removed by a heat treatment at a temperature of the $A_3$ transformation point or higher for such a short period of time as 30 minutes or less, if this heat treatment is conducted immediately after removal from the mold while the cast iron product is still in a state that the $A_3$ transformation has not yet occurred in the matrix. On the other hand, if the heat treatment is conducted after once cooled to a lower temperature such as room temperature, the decomposition of a cementite phase requires much more time, usually nearly 2 or 3 hours. The reason why the decomposition of cementite can be achieved in such a short period of time in the heat treatment of the present invention is not necessarily clear, but it may be presumed that the cementite phase is not formed in a large amount when the thin cast iron product is not cooled to a low temperature. In general, since the thin cast iron product tends to be cooled rapidly, a large amount of cementite is likely to be formed in the cooling process. Accordingly, by conducting the heat treatment immediately after removal from the mold, the formation of a large amount of cementite can be prevented.

When the time of keeping the cast iron product in the uniform temperature zone of the continuous furnace exceeds 30 minutes, the cast iron product has increased strain, and such a long keeping time is economically disadvantageous.

The cast iron product is then transferred from the uniform temperature zone to a cooling zone in the furnace, and cooled in the cooling zone at a cooling speed of 40 ° C./min or less, preferably 5°–25 ° C./min. When the cooling speed exceeds 40 ° C./min, pearlite tends to remain in the resulting matrix, thereby hardening the spheroidal graphite cast iron and reducing its toughness and cuttability.

It is then taken out from the continuous furnace at a temperature of its $Ar_1$ transformation point (about 700° C. or lower) or lower, specifically 650° C. or lower.

The cast iron product thus produced has graphite particles having an average particle size of 20 μm or less and a maximum particle size of 60 μm or less. When the average particle size of the graphite particles exceeds 20 μm, the thin cast iron product has low fatigue strength. The preferred average particle size of the graphite particles is 15 μm or less. The cast iron product also has a ferrite matrix containing a reduced amount of pearlite. The pearlite content in the matrix is as small as 10% or less, particularly 5% or less.

Incidentally, the spheroidal graphite cast iron having such structure generally has a composition consisting essentially of 3.50–3.90 weight % of C, 2.0–3.0 weight % of Si, 0.35 weight % or less of Mn, 0.10 weight % or less of P, 0.02 weight % or less of S, 0.025–0.06 weight % of Mg and balance substantially Fe and inevitable impurities.

The term "thin spheroidal graphite cast iron article" used herein means a spheroidal graphite cast iron article whose substantial portion is as thin as 12 mm or less, preferably 8 mm or less, particularly 2–5 mm.

When the spheroidal graphite cast iron article is as thin as 12 mm or less, it is likely to be rapidly cooled, thereby forming a large amount of cementite in the matrix. When the rapidly cooled spheroidal graphite cast iron product is heated again to 850°–950° C., primarily deposited graphite particles tend to be diffused into the surrounding ferrite matrix, resulting in the generation of fine gaps between the graphite particles and the ferrite matrix. Thus, the conventional spheroidal graphite cast iron has relatively poor mechanical properties, when they are thin. This problem has been solved by the present invention. That is, the method of the present invention prevents fine gaps from being generated between the graphite particles and the ferrite matrix, because the spheroidal graphite cast iron is heat-treated at a temperature of the $A_3$ transformation point or higher in a short period of time of 30 minutes or less immediately after solidification. Incidentally, 2 mm is a lower limit in thickness in practical applications.

The spheroidal graphite cast iron product according to the present invention is suitable for thin castings such as suspension parts for automobiles, etc.

The present invention will be described in further detail by the following Examples.

EXAMPLE 1

(1) Composition

A cast iron material having a composition consisting of iron, inevitable impurities and the following components was used to produce a test piece having a stepwise increasing thickness as shown in FIG. 1.

C: 3.65 weight %
Si: 2.15 weight %
Mn: 0.20 weight %
P: 0.025 weight %
S: 0.009 weight %
Mg: 0.037 weight %

(2) Heat treatment

A spheroidal graphite cast iron melt having the above composition was poured into a mold at 1410° C., and the mold was removed by shake-out when the surface temperature of the cast iron product was 870° C. in a 3-mm-thick portion. It was immediately introduced into a uniform temperature zone of a continuous furnace kept at 850° C. and held therein for 5 minutes. After that, it was transferred into a cooling zone, where it was cooled to 650° C. over 10 minutes and then discharged from the furnace.

Figure 2:
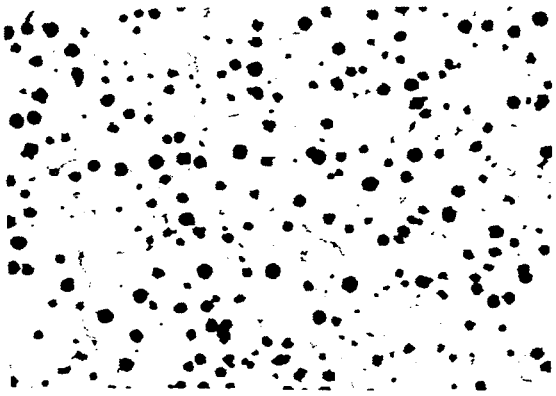
FIG. 2 is a scanning-type electron photomicrograph (×100) of the metal structure of a specimen prepared in Example 1.

With respect to the specimen obtained by the above heat treatment, scanning-type electron micrographic observation was conducted. The scanning-type electron photomicrograph of its 3-mm-thick portion is shown in FIG. 2.

Figure 3:
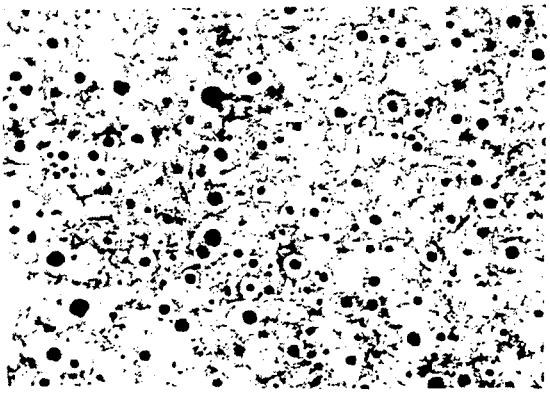
FIG. 3 is a scanning-type electron photomicrograph (×100) of the metal structure of an as-cast specimen having the same composition as that of FIG. 2.

Incidentally, the spheroidal graphite cast iron material having the same composition as above was used to produce an as-cast specimen of the same shape. The scanning-type electron photomicrograph of its 3-mm-thick portion is shown in FIG. 3.

EXAMPLE 2

(1) Composition

A cast iron material having a composition consisting of iron, inevitable impurities and the following components was used to produce a test piece having a stepwise increasing thickness as shown in FIG. 1.

C: 3.67 weight %
Si: 2.13 weight %
Mn: 0.21 %eight %
P: 0.027 weight %
S: 0.010 weight %
Mg: 0.038 weight %

(2) Heat treatment

A spheroidal graphite cast iron melt having the above composition was poured into a mold at 1420° C., and the mold was removed by shake-out when the surface temperature of the cast iron product was 850° C. in a 2-mm-thick portion. It was immediately introduced into a uniform temperature zone of a continuous furnace kept at 850° C. and held therein for 10 minutes. After that, it was transferred into a cooling zone, where it was cooled to 650° C. over 18 minutes and then discharged from the furnace.

Figure 4:
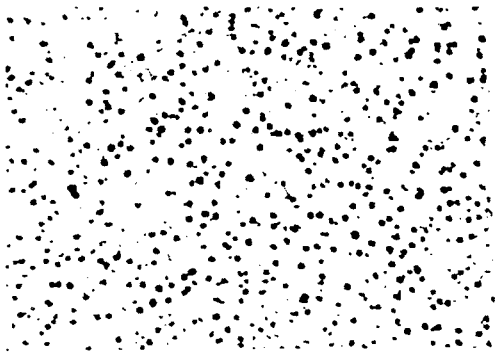
FIG. 4 is a scanning-type electron photomicrograph (×100) of the metal structure of a specimen prepared in Example 2.

With respect to the specimen obtained by the above heat treatment, scanning-type electron micrographic observation was conducted. The scanning-type electron photomicrograph of its 2-mm-thick portion is shown in FIG. 4.

Figure 5:
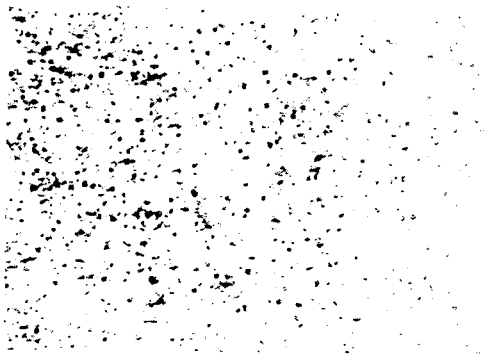
FIG. 5 is a scanning-type electron photomicrograph (×100) of the metal structure of an as-cast specimen having the same composition as that of FIG. 4.

Incidentally, the spheroidal graphite cast iron material having the same composition as above was used to produce an as-cast specimen of the same shape. The scanning-type electron photomicrograph of its 2-mm-thick portion is shown in FIG. 5.

EXAMPLE 3

(1) Composition

A cast iron material having a composition consisting of iron, inevitable impurities and the following components was used to produce a round rod having a diameter of 17 mm.

C: 3.65 weight %
Si: 2.14 weight %
Mn: 0.25 weight %
P: 0.026 weight %
S: 0.008 weight %
Mg: 0.039 weight %

A spheroidal graphite cast iron melt having the above composition was poured into a mold at 1420° C.

(2) Heat treatment (a) Heat treatment of the present invention

A half number of cast iron products were subjected to the heat treatment of the present invention. The mold was removed by shake-out when the surface temperature of each cast iron product was 850° C., and it was immediately introduced into a uniform temperature zone of a continuous furnace kept at 850° C. and held therein for 10 minutes. After that, it was transferred into a cooling zone, where it was cooled to 650° C. over 20 minutes and then discharged from the furnace.

(b) Conventional heat treatment

The other half number of cast iron products were subjected to a conventional heat treatment. That is, the mold was removed by shake-out, and each cast iron product was left to stand in the air so that it was cooled to room temperature. It was then introduced into a ferritization furnace, where it was heated to 850° C. over 2 hours. It was kept at 850° C. for 3 hours and then cooled to 650° C. over 10 hours. After that, it was taken out of the furnace.

(3) Measurement

Tensile test pieces (No. 4 according to JIS Z 2201) were prepared from the 17-mm round rods thus heat-treated, and measured with respect to tensile strength, yield strength, elongation, hardness and longitudinal modulus of elasticity.

Further, rotation bending fatigue test pieces each having a diameter of 12 mm (No. 1 according to JIS Z 2274) were prepared from the remaining 17-mm round rods to conduct fatigue strength measurement.

In addition, test pieces of 12 mm in diameter and 50 mm in length were prepared to measure sound velocities and densities.

Figure 6:
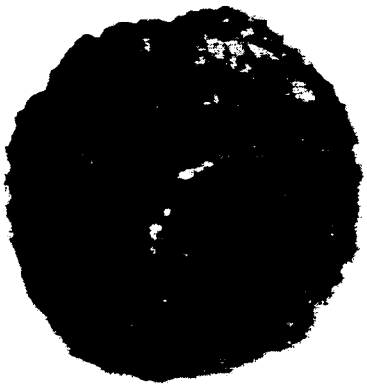
FIG. 6 is a scanning-type electron photomicrograph (×960) of a graphite particle in a specimen heat-treated in Example 3.
Figure 7:
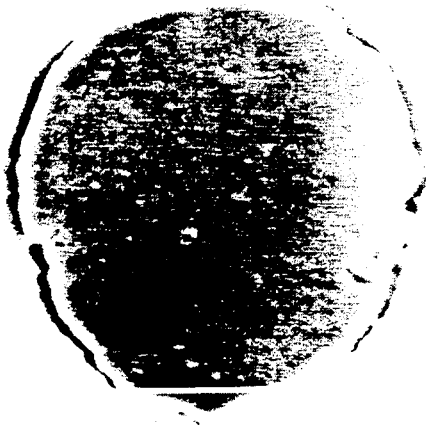
FIG. 7 PRIOR ART
FIG. 7 is a scanning-type electron photomicrograph (×960) of a graphite particle in a specimen heat-treated by the conventional method.

Scanning-type electron photomicrographic observation was conducted on both specimen subjected to the heat treatment of the present invention and that subjected to the conventional heat treatment. FIG. 6 shows a scanning-type electron photomicrograph (×960) of the specimen subjected to the heat treatment of the present invention, and FIG. 7 shows a scanning-type electron photomicrograph (×960) of the specimen subjected to the conventional heat treatment.

The above mechanical and physical properties are shown in Tables 1 and 2.

TABLE 1

| Sample No.* | Tensile Strength (kgf/mm$^2$) | Yield Strength (kgf/mm$^2$) | Elongation (%) | Hardness (HB) |
|---|---|---|---|---|
| 1 | 44.8 | 30.3 | 29.2 | 137 |
| 2 | 44.2 | 31.8 | 27.4 | 143 |
| 3 | 43.9 | 31.3 | 28.3 | 140 |
| 4 | 41.0 | 28.3 | 27.0 | 137 |
| 5 | 43.2 | 29.8 | 24.9 | 140 |
| 6 | 42.2 | 29.3 | 26.5 | 137 |

Note*:
Sample Nos. 1-3: Present invention.
Sample Nos. 4-6: Conventional heat treatment.

TABLE 2

| Sample No.* | Longitudinal Modulus of Elasticity (kgf/mm$^2$) | Sound Velocity (m/sec) | Density (g/cm$^3$) | Fatigue Strength (kgf/mm$^2$) |
|---|---|---|---|---|
| 1 | $1.65 \times 10^4$ | $5.56-5.57 \times 10^3$ | 7.02-7.04 | 19.0 |
| 2 | $1.61 \times 10^4$ | $5.40-5.44 \times 10^3$ | 7.01-7.03 | 16.5 |

Note*:
Sample No. 1: Present invention.
Sample No. 2: Conventional heat treatment.

It is clear from Tables 1 and 2 that the specimens of the present invention are superior to the conventional ones with respect to both mechanical properties and physical properties. Particularly with respect to fatigue strength, the former is higher than the latter by 15% or more.

Further, as is clear from a comparison of FIGS. 6 and 7, the specimens subjected to the conventional heat treatment (FIG. 7) have fine gaps around graphite particles dispersed in the matrix. It is presumed that these fine gaps are generated by the diffusion of primarily precipitated graphite into the matrix during the heat treatment of once cooled specimens at 850° C. for a long period of time.

On the other hand, there are substantially no fine gaps around the graphite particles in the specimens subjected to the heat treatment of the present invention (FIG. 6). This is because the specimens were kept at 850° C. for a very short period of time (10 minutes) as compared with the conventional ones (3 hours). By this heat treatment, the diffusion of graphite into the matrix substantially does not occur.

In addition, the heat treatment of the present invention was completed in only 30 minutes from introduction into the furnace to removal therefrom, while the conventional heat treatment took 15 hours from introduction into the furnace to removal therefrom. Therefore, in the heat treatment of the present invention, thermal energy is advantageously saved.

EXAMPLE 4

(1) Composition

A cast iron material having a composition consisting of iron, inevitable impurities and the following components was used to produce a test piece having a stepwise increasing thickness as shown in FIG. 1.

C: 3.65 weight %
Si: 2.15 weight %
Mn: 0.20 weight %
P: 0.025 weight %
S: 0.009 weight %
Mg: 0.037 weight %

(2) Heat treatment

A spheroidal graphite cast iron melt having the above composition was poured into a mold at 1410° C., and the mold was removed by shake-out when the surface temperature of the cast iron product was 870° C. in a 10-mm-thick portion. It was immediately introduced into a uniform temperature zone of a continuous furnace kept at 850° C. and held therein for 5 minutes. After that, it was transferred into a cooling zone, where it was cooled to 650° C. over 10 minutes and then discharged from the furnace.

Figure 8:
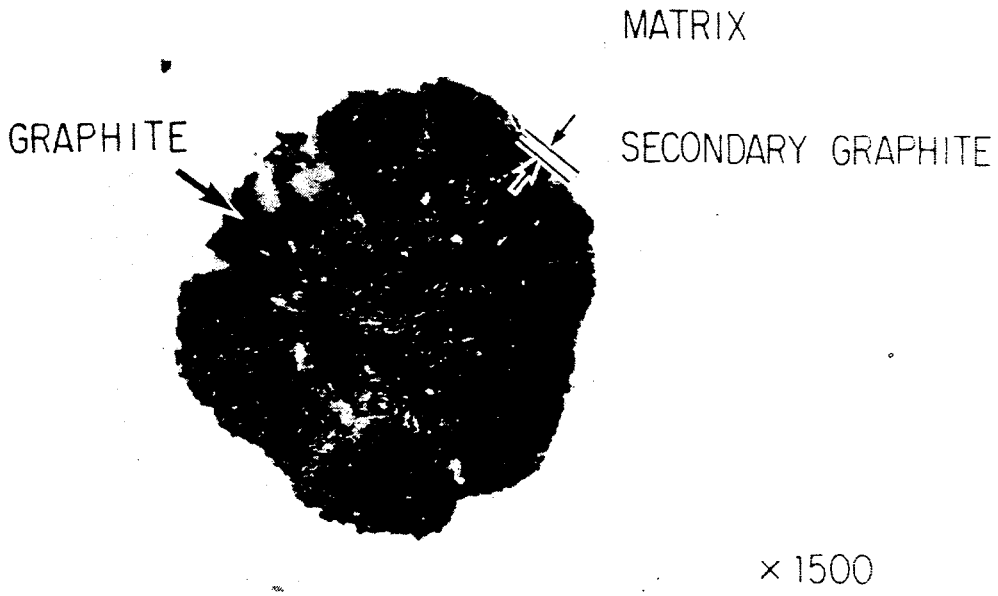
FIG. 8 is a scanning-type electron photomicrograph (×1500) of a graphite particle in a specimen heat-treated in Example 4.

With respect to the specimen obtained by the above heat treatment, scanning-type electron micrographic observation was conducted. The scanning-type electron photomicrograph (×1500) of its 10-mm-thick portion is shown in FIG. 8.

Figure 9:
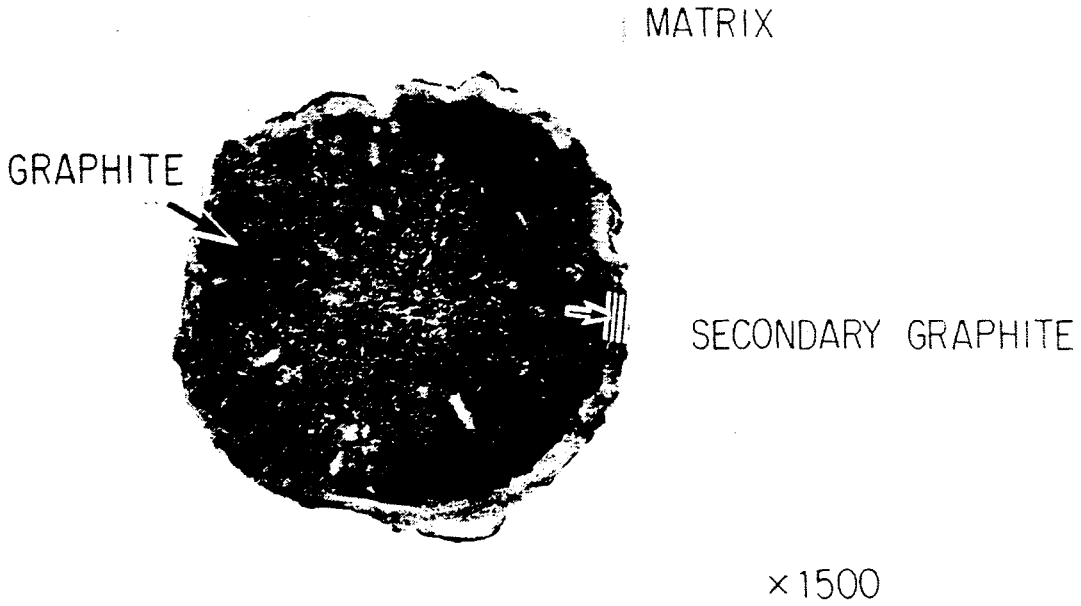
FIG. 9 is a scanning-type electron photomicrograph (×1500) of a graphite particle in a specimen heat-treated by the conventional method.

Incidentally, the spheroidal graphite cast iron material having the same composition as above was used to produce a specimen of the same shape. The specimen was once cooled to room temperature and heated again to 850° C. over 2 hours and kept at that temperature for 3 hours. It was then cooled to 650° C. over 10 hours. The scanning-type electron photomicrograph of its 10-mm-thick portion is shown in FIG. 9.

EXAMPLE 5

(1) Composition

Figure 10:
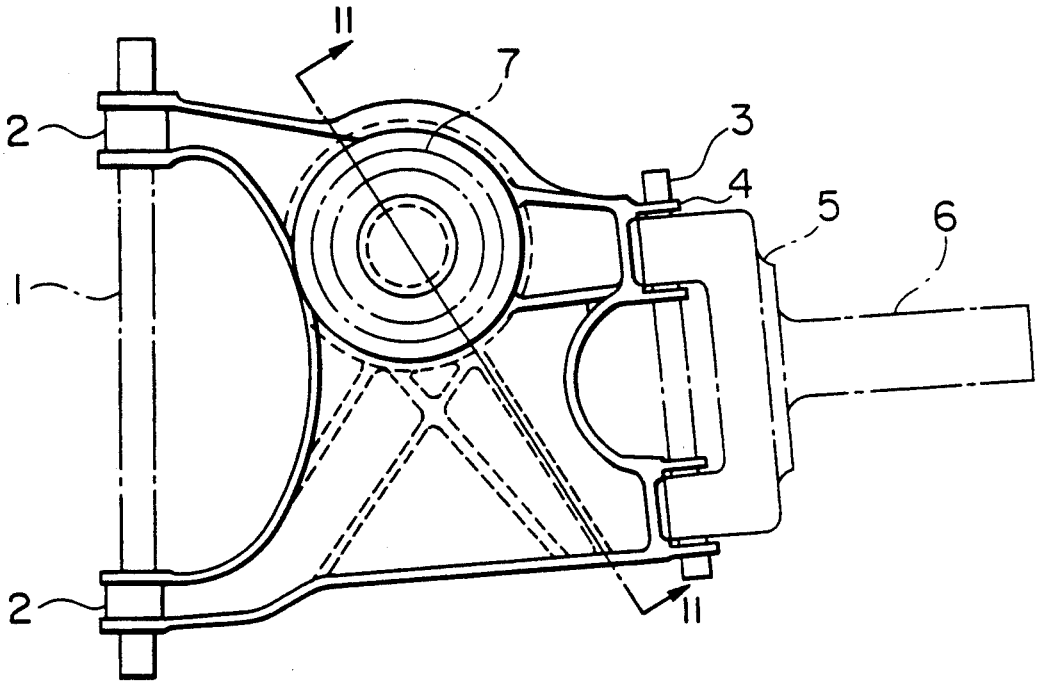
FIG. 10 is a plan view showing a control arm.
Figure 11:
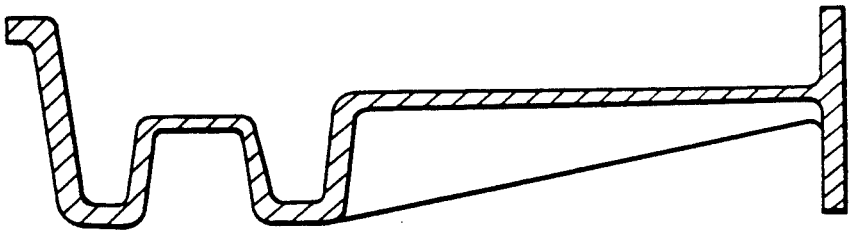
FIG. 11 is an enlarged cross-sectional view taken along the line A—A in FIG. 10.

A cast iron material having a composition consisting of iron, inevitable impurities and the following components was used to produce a control arm as shown in FIGS. 10 and 11.

C: 3.66 weight %
Si: 2.14 weight %
Mn: 0.23 weight %
P: 0.026 weight %
S: 0.009 weight %
Mg: 0.037 weight %

Incidentally, in FIG. 10, 1 denotes a shaft, 2 a pair of bearings, 3 a shaft, 4 a pair of bearings, 5 a knuckle steering, 6 a center shaft of rear wheels, and 7 a spring. The thickness of this control arm was between 3.5 mm and 8 mm.

(2) Heat treatment

A spheroidal graphite cast iron melt having the above composition was poured into a mold at 1410° C.

(a) Heat treatment of the present invention

The mold was removed by shake-out when the surface temperature of the cast iron product was 850° C. It was immediately introduced into a uniform temperature zone of a continuous furnace kept at 850° C. and held therein for 10 minutes. After that, it was transferred into a cooing zone, where it was cooled to 650° C. over 20 minutes and then discharged from the furnace.

(b) Conventional heat treatment

The mold was removed by shake-out, and the cast iron product was left to stand in the air so that it was cooled to room temperature. It was then introduced into a ferritization furnace, where it was heated to 850° C. over 2 hours. It was kept at 850° C. for 3 hours and then cooled to 650° C. over 10 hours. After that, it was taken out of the furnace.

(3) Measurement

A shaft 1 was inserted into a pair of bearings 2, 2, and a knuckle steering 5 was pivotally mounted to the control arm by a shaft 3 penetrating through a pair of bearings 4. A center shaft 6 inserted into the knuckle steering 5 and the shaft 1 were fixed, and a load of 2800 pounds (lbs) was applied to the spring 7.

Under this condition, rigidity and fatigue were measured on both specimens. The results are shown in Table 3.

TABLE 3

| Properties | Conventional Heat Treatment | Heat Treatment of Present Invention | Ratio(1) |
|---|---|---|---|
| Rigidity (lbs/deg) | 527 | 543 | 1.03 |
| Fatigue(2) | $42 \times 10^4$ | $100 \times 10^4$(3) | more than 2.38 |

Note
(1)A ratio of data of the present invention to the conventional one.
(2)Expressed by number of cycles until the specimen was broken.
(3)Not broken until 100 × 104 cycles.

As is clear from Table 3, the control arm of the present invention shows slightly improved rigidity and is much more resistant to fatigue failure than the conventional control arm. It is presumed that this improved fatigue strength is provided by the structure of the present invention in which there are substantially no fine gaps around graphite particles.

As described above in detail, since the thin high-strength spheroidal graphite cast iron articles have graphite particles substantially free from fine gaps around them, they show excellent mechanical properties as well as good physical properties.

In addition, in the heat treatment of the present invention, since cementite can be decomposed by heating at a temperature of the $A_3$ transformation point or higher in such a short period of time as 30 minutes or less, it is extremely advantageous in terms of energy consumption.

What is claimed is:

1. A thin high-strength article of spheroidal graphite cast iron having graphite particles dispersed in a ferrite matrix containing 10% or less of pearlite, wherein there are substantially no fine gaps of about 2 μm or more between said graphite particles and said ferrite matrix.

2. The thin high-strength article of spheroidal graphite cast iron according to claim 1, wherein said spheroidal graphite cast iron has a composition consisting essentially of 3.50–3.90 weight % of C, 2.0–3.0 weight % of Si, 0.35 weight % or less of Mn 0.10 weight % or less of P, 0.02 weight % or less of S, 0.025–0.06 weight % of Mg and balance substantially Fe and inevitable impurities.

3. The thin high-strength article of spheroidal graphite cast iron according to claim 1, wherein said graphite particles have an average particle size of 20 μm or less and a maximum particle size of 60 μm or less.

4. The thin high-strength article of spheroidal graphite cast iron according to claim 1, wherein substantial portions of said article are as thin as 12 mm or less.

5. The thin high-strength article of spheroidal graphite cast iron according to claim 1, wherein it is a suspension part for automobiles.

6. A method of producing a thin high-strength article of spheroidal graphite cast iron, comprising the steps of pouring a melt having a spheroidal graphite cast iron composition into a casting mold; removing said casting mold by shake-out after the completion of solidification of said melt, while substantially the entire portion of the resulting cast iron product is still at a temperature of its $A_3$ transformation point or higher; immediately introducing said cast iron product into a uniform temperature zone of a continuous furnace kept at a temperature of the $A_3$ transformation point or higher, where said cast iron product is held for 30 minutes or less to decompose cementite contained in the matrix: and transferring said cast iron product into a cooling zone of said continuous furnace to cool said cast iron product at such a cooling speed as to achieve the ferritization of said matrix.

7. The method of producing a thin high-strength article of spheroidal graphite cast iron according to claim 6, wherein the cooling speed of said cast iron product in said cooling zone of said continuous furnace is 40 ° C./min or less, and said cast iron product is taken out of said continuous furnace at a temperature lower than an $Ar_1$ transformation point of said spheroidal graphite cast iron.

8. The method of producing a thin high-strength article of spheroidal graphite cast iron according to claim 6, wherein the temperature of said uniform temperature zone of said continuous furnace is 850°-950° C.

9. The method of producing a thin high-strength article of spheroidal graphite cast iron according to claim 7, wherein the cast iron product resides in the uniform temperature zone of said continuous furnace heated at 850°-950° C. for 5-25 minutes, and cooled in the cooling zone of said continuous furnace at a cooling speed of 5°-25 ° C./min, and then taken out of said continuous furnace at a temperature of 650° C. or lower.

10. A thin high-strength article of spheroidal graphite case iron having graphite particles dispersed in a ferrite matrix containing 10% or less of pearlite, said article being produced by removing a cast article from a mold while substantially the entire portion of the cast article is still at a temperature of its $A_3$ transformation point or higher, immediately holding said cast article at a temperature of the $A_3$ transformation point or higher for about 30 minutes or less to decompose cementite contained in the matrix, and cooling said cast article at such a cooling speed as to achieve the ferritization of said matrix, whereby there are substantially no fine gaps between said graphite particles and said ferrite matrix.

11. The thin high-strength article of spheroidal graphite cast iron as in claim 2 having a combined yield strength of greater than 29.8 kgf/mm$^2$ and fatigue strength of greater than 16.5 kgf/mm$^2$.

12. The thin high-strength article of spheroidal graphite cast iron or in claim 10, wherein said spheroidal graphite cast iron has a composition consisting essentially of 3.50-3.90 weight % of C, 2.0-3.0 weight % of Si, 0.35 weight % or less of Mn, 0.10 weight % or less of P, 0.02 weight % or less of S, 0.025-0.06 weight % or Mg and balance substantially Fe and inevitable impurities, the cast iron having a combined yield strength of greater than 29.8 kgf/mm$^2$ and fatigue strength of greater than 16.5 kgf/mm$^2$.

* * * * *

UNITED STATES PATENT AND TRADEMARK OFFICE

CERTIFICATE OF CORRECTION

PATENT NO. : 4,990,194

DATED : Feb. 5, 1991

INVENTOR(S) : Obata et al.

It is certified that error appears in the above-identified patent and that said Letters Patent is hereby corrected as shown below:

Claim 2, col. 8, line 67, "Mn" should be followed by --,--.

Claim 6, col. 9, line 25, ":" should be --;--.

Claim 12, col. 10, line 34, "or" should be --of--2nd occur.

Signed and Sealed this

Twenty-first Day of July, 1992

*Attest:*

DOUGLAS B. COMER

*Attesting Officer*

*Acting Commissioner of Patents and Trademarks*